US010119083B2

(12) United States Patent
Oprins et al.

(10) Patent No.: US 10,119,083 B2
(45) Date of Patent: Nov. 6, 2018

(54) METHOD FOR CONVERTING A HIGH-BOILING HYDROCARBON FEEDSTOCK INTO LIGHTER BOILING HYDROCARBON PRODUCTS

(71) Applicants: SAUDI BASIC INDUSTRIES CORPORATION, Riyadh (SA); SABIC GLOBAL TECHNOLOGIES B.V., Bergen op Zoom (NL)

(72) Inventors: Arno Johannes Maria Oprins, Geleen (NL); Andrew Mark Ward, Wiltshire (GB); Ravichander Narayanaswamy, Bangalore (IN)

(73) Assignees: SAUDI BASIC INDUSTRIES CORPORATION, Riyadh (SA); SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 15/121,275

(22) PCT Filed: Dec. 23, 2014

(86) PCT No.: PCT/EP2014/079218
§ 371 (c)(1),
(2) Date: Aug. 24, 2016

(87) PCT Pub. No.: WO2015/128041
PCT Pub. Date: Sep. 3, 2015

(65) Prior Publication Data

US 2016/0362617 A1 Dec. 15, 2016

(30) Foreign Application Priority Data

Feb. 25, 2014 (EP) ..... 14156639

(51) Int. Cl.
*C10G 69/06* (2006.01)
*C10G 69/02* (2006.01)
(Continued)

(52) U.S. Cl.
CPC ..... *C10G 69/06* (2013.01); *C10G 9/36* (2013.01); *C10G 11/18* (2013.01); *C10G 29/205* (2013.01);
(Continued)

(58) Field of Classification Search
CPC ..... C10G 9/36; C10G 11/18; C10G 29/205; C10G 65/10; C10G 65/12; C10G 69/02; C10G 69/06
See application file for complete search history.

(56) References Cited

U.S. PATENT DOCUMENTS 3,660,270 A 5/1972 Mason
4,137,147 A 1/1979 Franck et al.
(Continued)

FOREIGN PATENT DOCUMENTS

JP S49-014721 4/1974
JP H06-079123 3/1994
(Continued)

OTHER PUBLICATIONS

Speight, J.G. (1999). The Chemistry and Technology of Petroleum, Marcel-Dekker, 918 pgs (Office action cites pp. 608 & 609).*
(Continued)

*Primary Examiner* — Brian A McCaig
(74) *Attorney, Agent, or Firm* — Norton Rose Fulbright US LLP

(57) ABSTRACT

A process for converting high boiling hydrocarbon feedstock into lighter boiling hydrocarbon products in which the lighter boiling hydrocarbon products are suitable feedstock for petrochemical processes.

10 Claims, 1 Drawing Sheet

(51) Int. Cl.

| | |
|---|---|
| ***C10G 29/20*** | (2006.01) |
| ***C10G 65/10*** | (2006.01) |
| ***C10G 65/12*** | (2006.01) |
| ***C10G 9/36*** | (2006.01) |
| ***C10G 11/18*** | (2006.01) |

(52) U.S. Cl.

CPC ..... *C10G 65/10* (2013.01); *C10G 65/12* (2013.01); *C10G 69/02* (2013.01); *C10G 2300/107* (2013.01)

(56) References Cited

U.S. PATENT DOCUMENTS

| | | | | |
|---|---|---|---|---|
| 4,997,544 | A * | 3/1991 | Chou | C10G 65/04 208/149 |
| 5,603,824 | A | 2/1997 | Kyan et al. | |
| 6,153,087 | A | 11/2000 | Bigeard et al. | |
| 6,270,654 | B1 | 8/2001 | Colyar et al. | |
| 7,214,308 | B2 | 5/2007 | Colyar | |
| 7,704,377 | B2 | 4/2010 | Duddy et al. | |
| 7,938,952 | B2 | 5/2011 | Colyar et al. | |
| 8,926,824 | B2 | 1/2015 | Morel | |
| 9,005,430 | B2 | 4/2015 | Fournier et al. | |
| 9,840,674 | B2 | 12/2017 | Weiss et al. | |
| 2008/0093261 | A1 | 4/2008 | Powers | |
| 2008/0093262 | A1 | 4/2008 | Gragnani et al. | |
| 2009/0050523 | A1 | 2/2009 | Halsey | |
| 2009/0159493 | A1 | 6/2009 | Bhattacharya | |
| 2012/0125811 | A1 | 5/2012 | Bridges et al. | |
| 2012/0125812 | A1 | 5/2012 | Bridges et al. | |
| 2012/0125813 | A1 | 5/2012 | Bridges et al. | |
| 2014/0299515 | A1 | 10/2014 | Weiss et al. | |
| 2016/0122666 | A1 | 5/2016 | Weiss et al. | |

FOREIGN PATENT DOCUMENTS

| | | |
|---|---|---|
| JP | 2011-084649 | 4/2011 |
| WO | WO 2016/146326 | 9/1916 |

OTHER PUBLICATIONS

International Search Report for International Application No. PCT/EP2014/079218 dated Mar. 23, 2015.

* cited by examiner

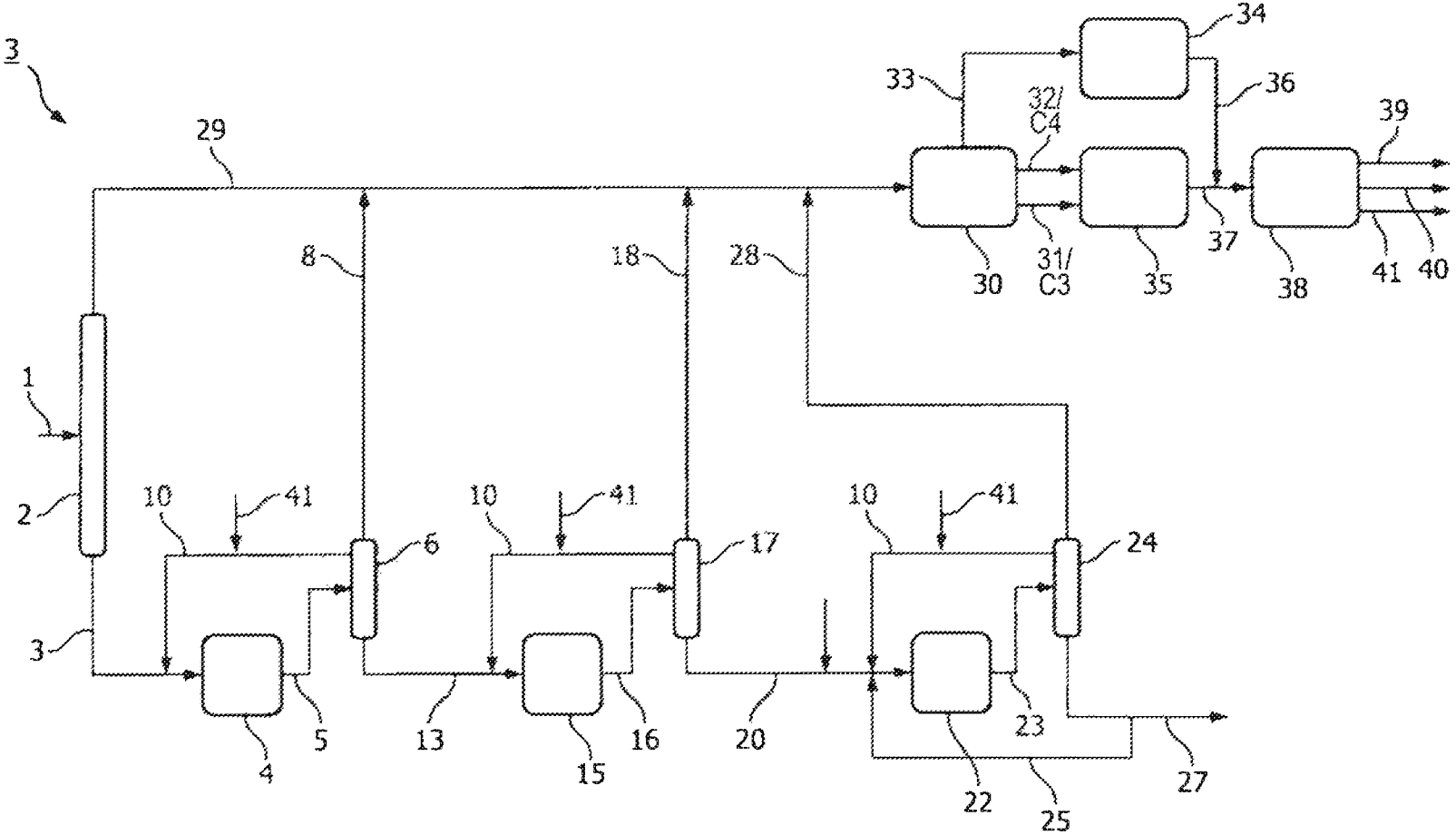
3
1
2
3
29
8
6
5
4
10
41
13
15
16
18
17
20
22
23
24
25
27
28
10
41
30
33
32/
C4
31/
C3
35
34
36
37
38
39
40
41

METHOD FOR CONVERTING A HIGH-BOILING HYDROCARBON FEEDSTOCK INTO LIGHTER BOILING HYDROCARBON PRODUCTS

TECHNICAL FIELD AND BACKGROUND OF THE INVENTION

The present invention relates to a process for converting a high-boiling hydrocarbon feedstock into lighter boiling hydrocarbon products. More in detail, the present invention relates to a process for converting hydrocarbons, especially hydrocarbons originating from refinery operations, such as for example atmospheric distillation unit or a fluid catalytic cracking unit (FCC), into lighter boiling hydrocracked hydrocarbons having a boiling point of cyclobutane and lower.

U.S. Pat. No. 4,137,147 relates to a process for manufacturing ethylene and propylene from a charge having a distillation point lower than about 360 DEG C. and containing at least normal and iso-paraffins having at least 4 carbon atoms per molecule, wherein: the charge is subjected to a hydrogenolysis reaction in a hydrogenolysis zone, in the presence of a catalyst, (b) the effluents from the hydrogenolysis reaction are fed to a separation zone from which are discharged (i) from the top, methane and possibly hydrogen, (ii) a fraction consisting essentially of hydrocarbons with 2 and 3 carbon atoms per molecule, and (iii) from the bottom, a fraction consisting essentially of hydrocarbons with at least 4 carbon atoms per molecule, (c) only the fraction consisting essentially of hydrocarbons with 2 and 3 carbon atoms per molecule is fed to a steam-cracking zone, in the presence of steam, to transform at least a portion of the hydrocarbons with 2 and 3 carbon atoms per molecule to monoolefinic hydrocarbons; the fraction consisting essentially of hydrocarbons with at least 4 carbon atoms per molecule, obtained from the bottom of the separation zone, is supplied to a second hydrogenolysis zone where it is treated in the presence of a catalyst, the effluent from the second hydrogenolysis zone is supplied to a separation zone to discharge, on the one hand, hydrocarbons with at least 4 carbon atoms per molecule which are recycled at least partly to the second hydrogenolysis zone, and, on the other hand, a fraction consisting essentially of a mixture of hydrogen, methane and saturated hydrocarbons with 2 and 3 carbon atoms per molecule; a hydrogen stream and a methane stream are separated from the mixture and there is fed to the steam-cracking zone the hydrocarbons of the mixture with 2 and 3 carbon atoms, together with the fraction consisting essentially of hydrocarbons with 2 and 3 carbon atoms per molecule as recovered from the separation zone following the first hydrogenolysis zone. At the outlet of the steam-cracking zone are thus obtained, in addition to a stream of methane and hydrogen and a stream of paraffinic hydrocarbons with 2 and 3 carbon atoms per molecule, olefins with 2 and 3 carbon atoms per molecule and products with at least 4 carbon atoms per molecule.

U.S. Pat. No. 3,660,270 relates to a process for producing gasoline which comprises hydrocracking a petroleum distillate in a first conversion zone, separating the effluent from the first conversion zone into a light naphtha fraction, a second fraction having an initial boiling point between 180 and 280 F. and an end boiling point between about 500' to 600 F., and a third heavy fraction, hydrocracking and dehydrogenating the second fraction in a second conversion zone in the presence of a catalyst and recovering from the second conversion zone at least one naphtha product.

US patent application No 2009/159493 relates to a method for hydroprocessing a hydrocarbon feedstock, said method employing multiple hydroprocessing zones within a single reaction loop, each zone having one or more catalyst beds. According to this method fresh feed is passed to the top of a fixed bed hydrotreater reactor. Hydrogen is added in between the first and second beds, and second and third beds of fixed bed hydrotreater reactor. The hydrotreated jet and diesel range material is recovered as liquid stream at high pressure and pumped to a hydrocracking reactor. Hydrogen is added in between the first and second beds and second and third beds of the hydrocracking reactor.

U.S. Pat. No. 5,603,824 relates to an integrated hydroprocessing method in which hydrocracking, dewaxing and desulfurization all occur in a single, vertical two bed reactor, wherein a distillate is split into heavy and light fractions, the heavy fraction being hydrocracked and partially desulfurized in the top reactor bed, and the effluent from the top bed is then combined with the light fraction and is cascaded into the bottom reactor bed, where dewaxing for pour point reduction and further desulfurization occurs.

Conventionally, crude oil is processed, via distillation, into a number of cuts such as naphtha, gas oils and residua. Each of these cuts has a number of potential uses such as for producing transportation fuels such as gasoline, diesel and kerosene or as feeds to some petrochemicals and other processing units.

Light crude oil cuts such as naphtha's and some gas oils can be used for producing light olefins and single ring aromatic compounds via processes such as steam cracking in which the hydrocarbon feed stream is evaporated and diluted with steam then exposed to a very high temperature (800° C. to 860° C.) in short residence time (<1 second) furnace (reactor) tubes. In such a process the hydrocarbon molecules in the feed are transformed into (on average) shorter molecules and molecules with lower hydrogen to carbon ratios (such as olefins) when compared to the feed molecules. This process also generates hydrogen as a useful by-product and significant quantities of lower value co-products such as methane and C9+ Aromatics and condensed aromatic species (containing two or more aromatic rings which share edges).

Typically, the heavier (or higher boiling point) aromatic rich streams, such as residua are further processed in a crude oil refinery to maximize the yields of lighter (distillable) products from the crude oil. This processing can be carried out by processes such as hydro-cracking (whereby the hydro-cracker feed is exposed to a suitable catalyst under conditions which result in some fraction of the feed molecules being broken into shorter hydrocarbon molecules with the simultaneous addition of hydrogen). Heavy refinery stream hydrocracking is typically carried out at high pressures and temperatures and thus has a high capital cost.

An aspect of the conventional hydrocracking of heavy refinery streams such as residua is that this is typically carried out under compromise conditions which are chosen to achieve the desired overall conversion. As the feed streams contain a mixture of species with a range of easiness of cracking this results in some fraction of the distillable products formed by hydrocracking of relatively easily hydrocracked species being further converted under the conditions necessary to hydrocrack species more difficult to hydrocrack. This increases the hydrogen consumption and heat management difficulties associated with the process, and also increases the yield of light molecules such as methane at the expense of more valuable species.

US patent application No's 2012/0125813, US 2012/0125812 and US 2012/0125811 relate to a process for cracking a heavy hydrocarbon feed comprising a vaporization step, a distillation step, a coking step, a hydroprocessing step, and a steam cracking step. For example, US patent application No 2012/0125813 relates to a process for steam cracking a heavy hydrocarbon feed to produce ethylene, propylene, C4 olefins, pyrolysis gasoline, and other products, wherein steam cracking of hydrocarbons, i.e. a mixture of a hydrocarbon feed such as ethane, propane, naphtha, gas oil, or other hydrocarbon fractions, is a non-catalytic petrochemical process that is widely used to produce olefins such as ethylene, propylene, butenes, butadiene, and aromatics such as benzene, toluene, and xylenes.

US patent application No 2009/0050523 relates to the formation of olefins by thermal cracking in a pyrolysis furnace of liquid whole crude oil and/or condensate derived from natural gas in a manner that is integrated with a hydrocracking operation.

US patent application No 2008/0093261 relates to the formation of olefins by hydrocarbon thermal cracking in a pyrolysis furnace of liquid whole crude oil and/or condensate derived from natural gas in a manner that is integrated with a crude oil refinery.

BRIEF SUMMARY OF THE INVENTION

An object of the present invention is to provide a method for converting a high-boiling hydrocarbon feedstock into lighter boiling hydrocarbon products.

Another object of the present invention is to provide a method for converting a high-boiling hydrocarbon feedstock into lighter boiling hydrocarbon products, especially LPG, while minimizing methane.

Another object of the present invention is to provide a method for producing light boiling hydrocarbon products which can be used as a feedstock for further chemical processing.

Another object of the present invention is to provide a method for converting a high-boiling hydrocarbon feedstock into high value products, wherein the production of low value products such as methane and C9+ aromatics species is minimized.

BRIEF DESCRIPTION OF THE DRAWINGS

FIG. 1 is a schematic depiction of the process for converting high-boiling point hydrocarbon feedstock into lighter boiling hydrocarbon products.

DETAILED DESCRIPTION OF THE INVENTION

The present invention relates to process for converting a high-boiling hydrocarbon feedstock into lighter boiling hydrocarbon products, said lighter boiling hydrocarbon products being suitable as a feedstock for petrochemicals processes, said converting process comprising the following steps of:

feeding a heavy hydrocarbon feedstock to a cascade of hydrocracking unit(s), cracking said feedstock in a hydrocracking unit, separating said cracked feedstock into a stream comprising hydrogen, a stream comprising a light boiling hydrocarbon fraction and a bottom stream comprising a heavier hydrocarbon fraction feeding said bottom stream of such a hydrocracking unit as a feedstock for a subsequent hydrocracking unit in said cascade of hydrocracking unit(s), wherein the process conditions in each hydrocracking unit(s) are different from each other, in which the hydrocracking conditions from the first to the subsequent hydrocracking unit(s) increase from least severe to most severe, wherein the reactor type design of the last hydrocracking unit in said cascade of hydrocracking unit(s), is of the slurry phase type, and sending the light boiling hydrocarbon fractions from each hydrocracking unit(s) to petrochemicals processes, comprising at least a steam cracking unit and one or more units chosen from the group of pentane dehydrogenation unit, propane dehydrogenation unit, butane dehydrogenation unit and mixed propane-butane dehydrogenation unit.

It is preferred that the lighter boiling hydrocarbon fractions from all hydrocracking units in said cascade of hydrocracking unit(s) are hydrocarbons having a boiling point lower than cyclobutane, or in a preferred embodiment methylpropane (isobutene). According to another embodiment the lighter boiling hydrocarbon fractions from all hydrocracking units in said cascade of hydrocracking unit(s) are hydrocarbons having a boiling point lower than C5, more preferably lower than C6.

According to another embodiment each hydrocracking unit present in the cascade of hydrocracking units is optimized to a specific yield distribution of lighter products, e.g. one hydrocracking unit to make mainly propane and another hydrocracking unit to make mainly butane. In such an embodiment wherein the compositions of the light boiling hydrocarbon fractions are different, it is preferred to further process the light boiling hydrocarbon fractions separately.

The term "cascade of hydrocracking unit(s)" as used herein means a series of hydrocracking units. The hydrocracking units are separated from each other by a separation unit, i.e. a unit in which the cracked feedstock is separated into a top stream comprising a light boiling hydrocarbon fraction and a bottom stream comprising a heavy hydrocarbon fraction. And the bottom stream comprising a heavy hydrocarbon fraction of such a hydrocracking unit is a feedstock for a subsequent hydrocracking unit. Such a construction is different from a construction wherein several catalyst beds are arranged vertically wherein the effluent from one bed is cascaded into another bed, namely from the top bed into the bottom bed, since such a cascade does not apply the intermediate step of withdrawal of the complete effluent and the separation thereof into a top stream comprising a light boiling hydrocarbon fraction and a bottom stream comprising a heavy hydrocarbon fraction, wherein the bottom stream comprising a heavy hydrocarbon fraction is a feedstock for a subsequent hydrocracking unit. The separation unit herein may comprise several separation sections.

The petrochemicals processes further preferably comprise one or more chosen from the group of alkylation processes, high severity catalytic cracking (including high severity FCC), light naphtha aromatization (LNA), reforming and mild hydrocracking.

The choice of the petrochemicals processes mentioned before is dependent on the composition of the light boiling hydrocarbon fractions. If, for example a stream mainly comprising C5 is obtained, the pentane dehydrogenation unit would be preferred. In addition, such a stream mainly comprising C5 can be sent to high severity catalytic cracking (including high severity FCC) for making propylene and ethylene as well. If, for example a stream mainly comprising C6 is obtained, a process such as light naphtha aromatization (LNA), reforming and mild hydrocracking, would be preferred.

According to a preferred embodiment the present process further comprises separating said light boiling hydrocarbon fractions into a stream comprising C1, a stream comprising C2, a stream comprising C3 and a stream comprising C4 and preferably feeding said stream comprising C3 to a propane dehydrogenation unit and preferably feeding said stream comprising C4 to a butane dehydrogenation unit, respectively.

The stream comprising C2 is preferably fed to a gas steam cracker unit.

Thus the present method comprises as specific petrochemicals processes the combination of a gas steam cracker unit and at least one unit chosen from the group of a butanes dehydrogenation unit, a propane dehydrogenation unit, a combined propane-butanes dehydrogenation unit, or a combination of units thereof to produce a mixed product stream. This combination of units provides a high yield of the desired products, namely olefinic and aromatic petrochemicals, wherein the portion of the crude oil converted to LPG is increased significantly.

According to a preferred embodiment the light boiling hydrocarbon fractions comprising stream is separated into one or more streams, wherein the stream comprising hydrogen is preferably used as a hydrogen source for hydrocracking purpose, the stream comprising methane is preferably used as a fuel source, the stream comprising ethane is preferably used as a feed for the gas steam cracking unit, the stream comprising propane is preferably used as a feed for a propane dehydrogenation unit, a stream comprising butanes is preferably used as a feed for a butane dehydrogenation unit, a stream comprising C1-minus is preferably used as a fuel source and/or as a hydrogen source, a stream comprising C3-minus is preferably used as a feed for a propane dehydrogenation unit but, according to another embodiment, also as a feed for the gas steam cracking unit, a stream comprising C2-C3 is preferably used as a feed for a propane dehydrogenation unit, but, according to another embodiment, also as a feed for the gas steam cracking unit, a stream comprising C1-C3 is preferably used as a feed for a propane dehydrogenation unit, but, according to another embodiment, also as a feed for the gas steam cracking unit, a stream comprising C1-C4 butanes is preferably used as a feed for a butane dehydrogenation unit, a stream comprising C2-C4 butanes is preferably used as a feed for a butane dehydrogenation unit, a stream comprising C2-minus is preferably used as a feed for the gas steam cracking unit, a stream comprising C3-C4 is preferably used as a feed for a propane or butane dehydrogenation unit, or a combined propane and butane dehydrogenation unit, a stream comprising C4-minus is preferably used as a feed for a butane dehydrogenation unit.

According to the present process it is preferred that the lighter boiling hydrocarbon fractions from all hydrocracking units in said cascade of hydrocracking unit(s) are hydrocarbons having a boiling point greater than methane and equal to or lower than that of cyclobutane.

According to the present invention a hydrocarbon feedstock, for example crude oil, is fed to a fractional distillation column (ADU) and the material boiling at a higher temperature than 12° C. (the boiling point for cyclobutane) is fed to a series (or cascade) of hydrocracking process reactors with a range of (increasingly severe) operating conditions/catalysts etc. chosen to maximise the yield of material suitable for other petrochemicals processes (such as steam crackers or dehydrogenation units) without the need for another stage of hydrocracking. After each step of hydrocracking the remaining heavy material (boiling point>12° C.) is separated from the lighter products and only the heavier materials are fed to the next, more severe, stage of hydrocracking whilst lighter material is separated and thus not exposed to further hydrocracking. This lighter material (boiling point<12° C.) is fed to other processes such as steam cracking, dehydrogenation processes or a combination of these processes. The present invention will be discussed in more detail in the experimental section of this application.

The present inventors optimise each step of the hydrocracking cascade (via chosen operating conditions, catalyst type and reactor design) such that the ultimate yield of desired products (material with boiling point higher than methane and lower than cyclobutane) is maximised and capital and associating operating costs are minimised.

It is preferred to combine the lighter boiling hydrocarbon fractions from all hydrocracking units and to process them as a feedstock for petrochemicals processes.

The present process further comprises separating hydrogen from the lighter boiling hydrocarbon products and feeding the hydrogen thus separated to a hydrocracking unit in the cascade of hydrocracking unit(s), wherein the hydrogen thus separated is preferably fed to a preceding hydrocracker unit in the cascade of hydrocracking unit(s).

The hydrocarbon feedstock can be a cut from a crude oil atmospheric distillation unit (ADU), such as naphtha, ADU bottom stream, atmospheric gas oils, and products from refinery processes, such as cycle oils from an FCC unit or heavy cracked naphthas.

The present cascade of hydrocracking units comprises preferably at least two hydrocracking units, wherein said hydrocracking units are preferably preceded by a hydrotreating unit, wherein the bottom stream of said hydrotreating unit is used as a feedstock for said first hydrocracking unit, especially that the temperature prevailing in said hydrotreating unit is higher than in said first hydrocracking unit.

In addition it is preferred that the temperature in the first hydrocracking unit is lower than the temperature in the second hydrocracking unit.

In addition it is also preferred that the particle size of the catalyst present in the cascade of hydrocracking units decreases from the first hydrocracking unit to the subsequent hydrocracking unit(s).

According to a preferred embodiment the temperature in the cascade of hydrocracking units increases, wherein the temperature prevailing in said second hydrocracking unit is higher than in said hydrotreating unit.

The reactor type design of the present hydrocracking unit(s) is chosen from the group of the fixed bed type, ebulatted bed reactor type and the slurry phase type. This may involve a series of dissimilar processes such as first a fixed bed hydrotreater, followed by a fixed bed hydrocracker, followed by an ebullated bed hydro-cracker, followed by a last hydrocracker which is a slurry hydrocracker. Alternatively, the reactor type design of said hydrotreating unit is of the fixed bed type, the reactor type design of said first hydrocracking unit is of the ebulatted bed reactor type and the reactor type design of said second hydrocracking unit is of the slurry phase type.

In the present process it is preferred to recycle the bottom stream of the final hydrocracking unit to the inlet of said final hydrocracking unit.

The invention will be described in further detail below and in conjunction with the attached drawings in which the same or similar elements are referred to by the same number.

FIG. 1 is a schematic illustration of an embodiment of the process of the invention.

Referring now to the process and apparatus schematically depicted in the sole FIG. 1, there is shown crude oil feed 1, an atmospheric distillation unit 2 for separating the crude oil into stream 29, comprising hydrocarbons having a boiling point of cyclobutane, i.e. 12° C., and lower. Bottom stream 3 leaving distillation unit 2 is fed to a hydro processing unit 4, for example a hydro treating unit, wherein the thus treated hydrocarbons 5 are sent to a separation unit 6 producing a gaseous stream 8, a hydrogen comprising stream 10 and a bottom stream 13 comprising hydrocarbons having a boiling point of cyclobutane and higher. Although separation unit 6 has been identified as a single separation unit, in practice such a separation unit may comprise several separation units. Stream 13 is fed into a hydrocracking unit 15 and its effluent 16 is sent to a separation unit 17 producing gaseous stream 18, a hydrogen comprising stream 10 and a bottom stream 20 comprising hydrocarbons having a boiling point of cyclobutane and higher. Hydrogen make up is indicated with reference number 41. The effluent 20 from separation unit 17 is sent to a further hydrocracking unit 22 and its effluent 23 is sent to a separation unit 24 producing a gaseous top stream 28, a hydrogen comprising stream 10 and a bottom stream 27. Bottom stream 27 can be partly recycled as stream 25 to the inlet of hydrocracking unit 22. Bottom stream 27 can be further separated in separation units (not shown here). The hydrogen containing stream 10 leaving separation unit 24 is sent to a compressor and returned to the inlet of hydrocracking unit 22. Since hydrocracking unit 22 in this FIGURE is the last hydrocracking unit in the cascade, the reactor type design of this hydrocracking unit 22 is of the slurry phase type.

The top stream 29 coming from distillation unit 2 and streams 8, 18 and 28 are and sent to a number of processing units. According to a preferred embodiment the combined streams 29, 8, 18, and 28, i.e. light boiling hydrocarbon fractions, are separated in separator section 30, which section 30 may comprise several separation units. In the FIGURE three separated streams 31, 32, 33 have been shown, but the present invention is not restricted to any number of streams. Stream 33, for example a stream comprising C2, is sent to gas steam cracker unit 34, and its effluent 36 is sent to a further separation section 38, which section 38 may comprise several separation units. Streams 31, 32 are sent to a dehydrogenation unit 35, such as one or more of pentane dehydrogenation unit, propane dehydrogenation unit, butane dehydrogenation unit and mixed propane-butane dehydrogenation unit. For example a stream comprising C3 31 is sent to a propane dehydrogenation unit 35 and a stream comprising C4 32 is sent to a butane dehydrogenation unit 35. The effluent 37 is sent to a further separation section 38, which section 38 may comprise several separation units. Although not shown, other examples of petrochemicals processes, in addition to gas steam cracking unit 34 and dehydrogenation unit 35, are one or more chosen form aromatization unit, alkylation processes, high severity catalytic cracking (including high severity FCC), light naphtha aromatization (LNA), reforming and mild hydrocracking. Separation section 38 produces into individual streams 39, 40, 41. From individual streams 39, 40, 41 olefins and aromatics can be recovered. Although only three individual streams 39, 40, 41 have been shown, the present invention is not restricted to any number of individual streams.

As shown here it is possible to separate the combined streams 29, 8, 18, 28 into a into a stream comprising C1, a stream comprising C2, a stream comprising C3 and a stream comprising C4 and feeding said stream comprising C3 to a propane dehydrogenation unit 35 and feeding the stream comprising C4 to a butane dehydrogenation unit 35, and feeding the stream comprising C2 to a gas steam cracker unit 34.

In addition, it is also possible to run hydroprocessing unit 4, hydrocracking unit 15 and hydrocracking unit 22 under such processing conditions that the composition of streams 8, 18 and 28 are such that each of streams 8, 18 and 28 is sent to one or more different processing units, as mentioned before. Although the FIGURE shows that streams 8, 18 and 28 are combined and sent as one single feed to unit 30, some embodiments prefer to have separate streams 8, 18 and 28 sent to individual processing units. This means that separator section 30 can be by-passed.

The invention claimed is:

1. A process for converting a high-boiling hydrocarbon feedstock into lighter-boiling hydrocarbon products, said lighter-hydrocarbon products being suitable as feedstocks for petrochemical processes, said converting process comprising:

feeding a heavy hydrocarbon feedstock to a cascade of hydrocracking unit(s), wherein the cascade of hydrocracking units comprises at least two hydrocracking units, wherein on of the units is a last hydrocracking unit in said cascade of hydrocracking units;

cracking said feedstock in the hydrocracking units;

separating said cracked feedstock into at least a stream comprising a light-boiling hydrocarbon fraction and a bottom stream comprising a heavier hydrocarbon fraction than said light-boiling fraction;

feeding said bottom stream of such a hydrocracking unit as a feedstock for a subsequent hydrocracking unit in said cascade of hydrocracking units, wherein process conditions in each hydrocracking unit are different from each other, in which temperature conditions from first to subsequent hydrocracking units increases, wherein a reactor type design of the last hydrocracking unit is of a slurry phase type;

sending the light-boiling hydrocarbon fractions from each of said hydrocracking units to petrochemical processes, comprising at least a gas steam cracking unit, a propane dehydrogenation unit, and a butane dehydrogenation unit and one or more units chosen from a pentane dehydrogenation unit and a mixed propane-butane dehydrogenation unit;

separating said light boiling hydrocarbon fractions into a stream comprising C2, a stream comprising C3 and a stream comprising C4;

feeding said stream comprising C3 to the propane dehydrogenation unit;

feeding said stream comprising C4 to the butane dehydrogenation unit; and feeding said stream comprising C2 to the gas steam cracker unit.

2. The process according to claim 1, wherein the lighter boiling hydrocarbon fractions from all hydrocracking units in said cascade of hydrocracking units are hydrocarbons having a boiling point higher than methane and equal to or lower than that of cyclobutane.

3. The process according to claim 1, further comprising separating said cracked feedstock into a stream comprising hydrogen; and feeding said stream comprising hydrogen to a hydrocracking unit in said cascade of hydrocracking units.

4. The process according to claim 1, wherein said heavy hydrocarbon feedstock is chosen from crude oil atmospheric distillation unit (ADU) including naphtha, ADU bottom stream, and atmospheric gas oils, and products from refinery processes.

5. The process according to claim 1, wherein said hydrocracking units preceded by a hydrotreating unit and bottom stream of said hydrotreating unit is used as a feedstock for said first hydrocracking unit, wherein temperature in said hydrotreating unit is higher than in said first hydrocracking unit.

6. The process according to claim 5, wherein a temperature in the cascade of hydrocracking units increases and temperature in said second hydrocracking unit is higher than in said hydrotreating unit.

7. The process according to claim 5, wherein the reactor type design of said hydrotreating unit is of the fixed bed type.

8. The process according to claim 5, wherein the reactor type design of said first hydrocracking unit is of the ebulated bed reactor type.

9. The process according to claim 1, wherein a bottom stream of a final hydrocracking unit is recycled to an inlet of said final hydrocracking unit.

10. A process for converting a high-boiling hydrocarbon feedstock into lighter-boiling hydrocarbon products, said lighter-hydrocarbon products being suitable as feedstocks for petrochemical processes, said converting process comprising:

feeding a heavy hydrocarbon feedstock to a cascade of hydrocracking unit(s), cracking said feedstock in the hydrocracking unit(s), separating said cracked feedstock into a stream comprising hydrogen, a stream comprising a light-boiling hydrocarbon fraction and a bottom stream comprising a heavier hydrocarbon fraction, feeding said bottom stream of such a hydrocracking unit as a feedstock for a subsequent hydrocracking unit in said cascade of hydrocracking units, wherein process conditions in each hydrocracking unit are different from each other, in which the hydrocracking conditions from the first to subsequent hydrocracking units increase from least severe to most severe, wherein a reactor type design of the last hydrocracking unit is of a slurry phase type, and sending the light-boiling hydrocarbon fractions from each of said hydrocracking units to petrochemical processes, comprising at least a gas steam cracking unit, a propane dehydrogenation unit, and a butane dehydrogenation unit and one or more units chosen from a pentane dehydrogenation unit and a mixed propane-butane dehydrogenation unit, wherein a catalyst is present in the cascade of hydrocracking units and a particle size of the catalyst present in the cascade of hydrocracking units decreases from the first hydrocracking unit to the subsequent hydrocracking unit.

* * * * *